US006476309B2

(12) United States Patent
Gaglio

(10) Patent No.: US 6,476,309 B2
(45) Date of Patent: Nov. 5, 2002

(54) MAGNETIC PICK-UP DEVICE FOR STRINGED MUSICAL INSTRUMENT

(76) Inventor: Giovanni Gaglio, Via Montemarino, 93 - 00060 Riano (Rome) (IT)

( * ) Notice: Subject to any disclaimer, the term of this patent is extended or adjusted under 35 U.S.C. 154(b) by 0 days.

(21) Appl. No.: 09/933,712

(22) Filed: Aug. 22, 2001

(65) Prior Publication Data

US 2002/0073829 A1 Jun. 20, 2002

(30) Foreign Application Priority Data

Dec. 14, 2000 (IT) ..... RM2000A0666

(51) Int. Cl.[7] ..... G10H 3/18
(52) U.S. Cl. ..... 84/726
(58) Field of Search ..... 84/723, 725–728

(56) References Cited

U.S. PATENT DOCUMENTS

| | | | |
|---|---|---|---|
| 2,896,491 A | 7/1959 | Lover | |
| 3,711,619 A | 1/1973 | Jones et al. | |
| 4,423,654 A | 1/1984 | Yamagami | |
| 4,501,185 A | 2/1985 | Blucher | |
| 5,767,431 A * | 6/1998 | Khanagov | 84/726 |

FOREIGN PATENT DOCUMENTS

| | | |
|---|---|---|
| DE | 1 944 422 | 2/1972 |
| GB | 2 291 736 A | 1/1996 |

OTHER PUBLICATIONS

Eligio Perucca, "Dizionario D'Ingegneria," Unione Tipografica–Editrice Torinese, Turin, 1979, vol. VII, p. 754. (with English translation).

* cited by examiner

*Primary Examiner*—Jeffrey Donels
(74) *Attorney, Agent, or Firm*—Young & Thompson

(57) ABSTRACT

A magnetic pick-up device for stringed musical instrument, comprising at least one permanent magnetic element (1), round which a coil (4-5) is wound, and a string (C) of the musical instrument, being part of the magnetic circuit including the permanent magnetic element (1), so that the vibrations of the string (C) change the reluctance of the magnetic circuit and generate an induced electromotive force in the coil (4-5) that is sent to a power amplifier (2). The coil (4-5) is constituted by a double-lead winding, each extremity (7-8) of which has one end being connected to the power amplifier and the other end being free.

6 Claims, 2 Drawing Sheets

MAGNETIC PICK-UP DEVICE FOR STRINGED MUSICAL INSTRUMENT

FIELD OF THE INVENTION

The present invention refers to a magnetic pick-up device for a stringed musical instrument. This kind of pick-up device, also called microphone, transducer, end instrument, magnetic sensor or, in everyday language, only "magnet", is adapted to detect and convert the vibration of the strings to electric signals, so that the vibration can be amplified and made audible by electric and electronic amplifiers. This kind of pick-up device is suitable for an electric guitar or other stringed instruments as the steel string of said instruments is an integral part of the pick-up device.

BACKGROUND OF THE INVENTION

A basic type of such a pick-up device is shown in FIG. 1 (see the headword "microphone" in Dizionario di Ingegneria, UTET, Turin, 1979). A ferromagnetic housing F, having a U-shaped cross-section, is located among the strings C ( the strings denoted as I, II, III and IV are shown in the figure) and the top or base plate (not shown) of a guitar. The longitudinal axis of the housing F is perpendicular to the strings C. One cylindrical magnet M is positioned inside the housing F in correspondence to each string C. A coil B is wound round every magnet M. All the coils are in series connection, with the winding being in the same direction. Every steel string C is part of the magnetic circuit relative to its own magnet M so that the vibrations of the string change the reluctance of the magnetic circuit and then produce an induced electromotive force in the coil B. The electric signal due to the string's vibration is transmitted to a power amplifier and then to a loudspeaker. A diagram of the circuit. That is limited to only one magnetic element 1 surrounded by a coil 4 which is connected to an amplifier A, denoted as 2, is shown in FIG. 2.

However, some improvements have been made to this basic type of pick-up device.

For example, U.S. Pat. No. 2,896,491 issued to S.E Lover on Jul. 28, 1959 discloses an "humbucking" pick-up device, comprising for each string a pair of coils so wound and disposed adjacent one another in order to eliminate the problem of 60 cycle signals from the power supply used in a public address system or other noise source such as fluorescent lamps, transformers, etc. near the pick-up device.

U.S. Pat. No. 3,711.619 granted to Jones et al. on Jan. 16, 1973 discloses a pick-up device involving two coils in which the fidelity of sound reproduced is stated as being improved over the conventional pick-up devices by virtue of a different number of turns in one winding from the number of turns constituting another winding.

Further, U.S. Pat. No. 4,501,185 issued to Blucher on Feb. 26, 1985 intendes to protect a two pick-up device having two coils, the wire diameter of one of which is different from the wire diameter of the other. In this way, low frequency cancellation is stated as being emphasized and, because of the difference in impedance characteristics resulting from different diameter wire on the respective coils, overall frequency response can be selectively adjusted to provide improved tonal qualities.

The pick-up devices for stringed instruments disclosed in the patents cited and in other documents, that are not considered here, provide that one coil or two coils are used for each string. When two coils are used, they are placed side by side and are characterized by spiral windings in opposite directions on respective magnetic cores having opposed poles. All the above said pick-up devices aim to satisfy some of the most important properties required to a pick-up device, including:

- capacity to receive and reproduce all frequencies produced by the strings;
- an output power or level, measured as signal voltage, being sufficient to drive amplifiers commercially available;
- a ready response, usually called "attack", which measures the capacity of transforming the string vibrations into an electric signal as fast as possible.

These properties are limited by constraints in manufacturing. such as, mainly, the number of turns of enameled copper wire in each coil, the wire diameter, the dimensions of the coil, the nature of the magnet, pole pieces if any, as above mentioned.

In particular, it has been found that output level on the one hand, and fidelity and capacity to reproduce an extended frequency range on the other hand, are contradictory properties. In fact, by increasing output level in volt of the pick-up device, gradually the capacity to reproduce high frequencies is lost, whereas an extremely accurate pick-up device, able to reproduce a wide frequency range cannot offer an adequate output level. Further, an increasing number of coils needs powerful magnets and relative pole pieces with the consequence of lost "attack". and the known so-called "humbucking" pick-up devices are poorly adapted to pick and reproduce very high frequencies. The problems as above mentioned can be resumed in the following.

Let us assume a Cartesian plan, having as abscissas the frequencies to be reproduced and as ordinates, over the origin the fidelity growing, and under the origin the power growing. The interval of performances that are considered as satisfying for every pick-up device is restricted to a determined area of the Cartesian plan as above defined.

The present invention aims to resolve the problems above mentioned.

SUMMARY OF THE INVENTION

In brief, the principal object of the invention is to provide a pick-up device having an optimal interval of performances that is larger than the pick-up devices in the prior art. This is obtained by a pick-up device provided with a coil having a great number of turns and then a high output level, without a consequent incapacity of reproducing high frequencies.

Another object of the invention is to provide a coil with an greater number of turns than the number of turns used in the past to manufacture both a single and a double coil pick-up device, the second one being provided with a further humbucking coil as before discussed.

According to the present invention a magnetic pick-up device for stringed musical instrument is provided, comprising at least one permanent magnetic element, round which a coil is wound, and a string of the musical instrument, being part of the magnetic circuit including said permanent magnetic element, so that the vibrations of the string change the reluctance of the magnetic circuit and generate an induced electromotive force in the coil that is sent to a power amplifier, wherein said coil is constituted by a double-lead winding, each extremity of which has one end being connected to the power amplifier and the other end being free.

In that way, according to the invention, the signal to be transmitted to the amplifier is taken up from not-free ends of the double-lead winding. Since there is no electric continuity between the two leads forming the coil, the signal is transmitted in a capacitive way from one lead to the other.

Further. the invention is very advantageous from the point of view of the tune correction.

In traditional pick-up devices, this correction is usually performed by a rheostat or potentiometer that gradually connects a capacitor in parallel to the two ends of the coil. However, such a correction does not do other than to eliminate the highest frequencies, giving only the impression of generating bass tunes.

Advantageously, in the pick-up device according to the invention, thanks to the dead free ends of the winding that are opposite to the ends connected to the amplifier, the correction of the tone of the pick-up device, besides in the traditional way, is achieved by connecting the free ends of the double-lead winding to a suitable both fixed or variable resistor. As a result, the pick-up of the invention has a coil with a double number of turns respect to a traditional pick-up device, and further is provided with a high impedance and is able to reproduce optimally a greater number of low frequencies, with a reduced loss of high notes with respect to the traditional pick-up device.

BRIEF DESCRIPTION OF THE DRAWING FIGURES

The present invention will be now described referring to its preferred embodiments, but it is understood that changes can be made without departing from the spirit of the present invention, with reference to the figures of the accompanying drawing, in which:

FIG. 1 a magnetic pick-up device according to the prior art for a stringed musical instrument;

DETAILED DESCRIPTION

Figure 3:
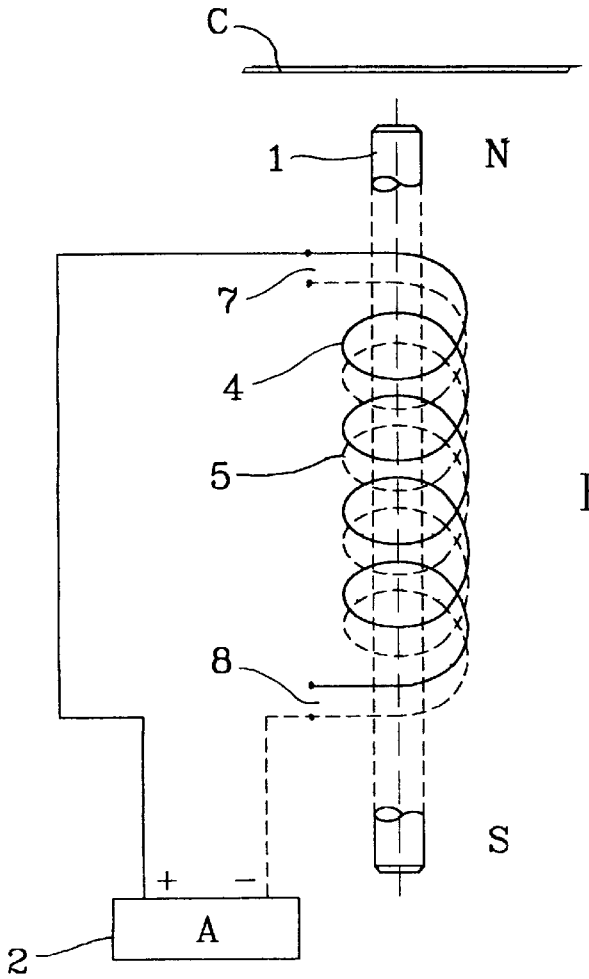
FIG. 3 shows a circuit diagram of the magnetic pick-up device according to the present invention.

Referring to the drawing, in FIG. 3 a magnetic pick-up device for a stringed musical instrument according to the invention is shown. Therein, a coil constituted by a double-lead winding is wound round a permanent magnetic element 1, made of a suitable material.

The double-lead winding consists of two conventionally isolated leads, for example made of enameled copper. For clarity sake, the one of two leads, denoted as 4, is shown by a continuous line, and the other one, denoted as 5, by dashed lines. The leads 4 and 5 are wound in with same-sense, coaxial turns, as shown diagrammatically in the drawing.

However the same schematic drawing can represent a double-lead winding consisting of two insulated leads twisted together and then wound in with same-sense. coaxial turns.

As shown in FIG. 3, the double-lead winding has an extremity 7 with an end, the one of lead 4, being connected to the power amplifier A 2 and the other end, the one of lead 5, being free, and vice versa in the other extremity 8 of the double-lead winding.

Figure 1:
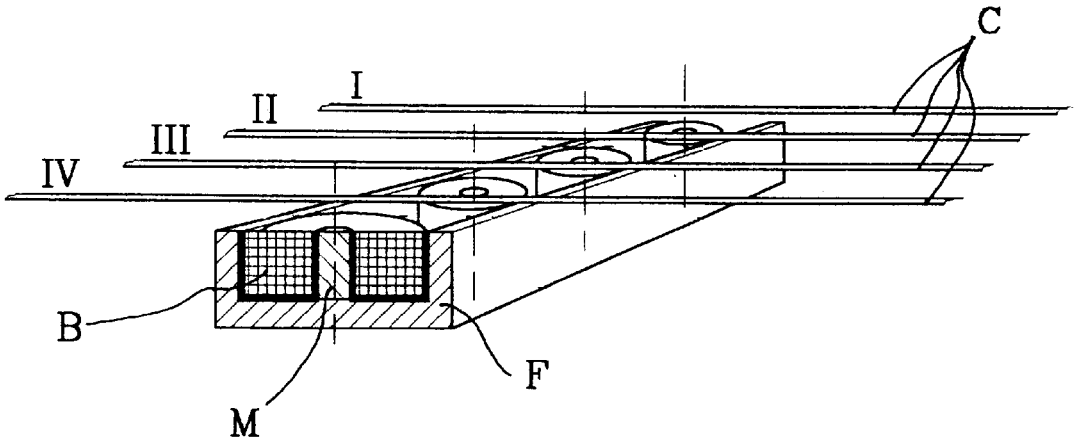
Figure 2:
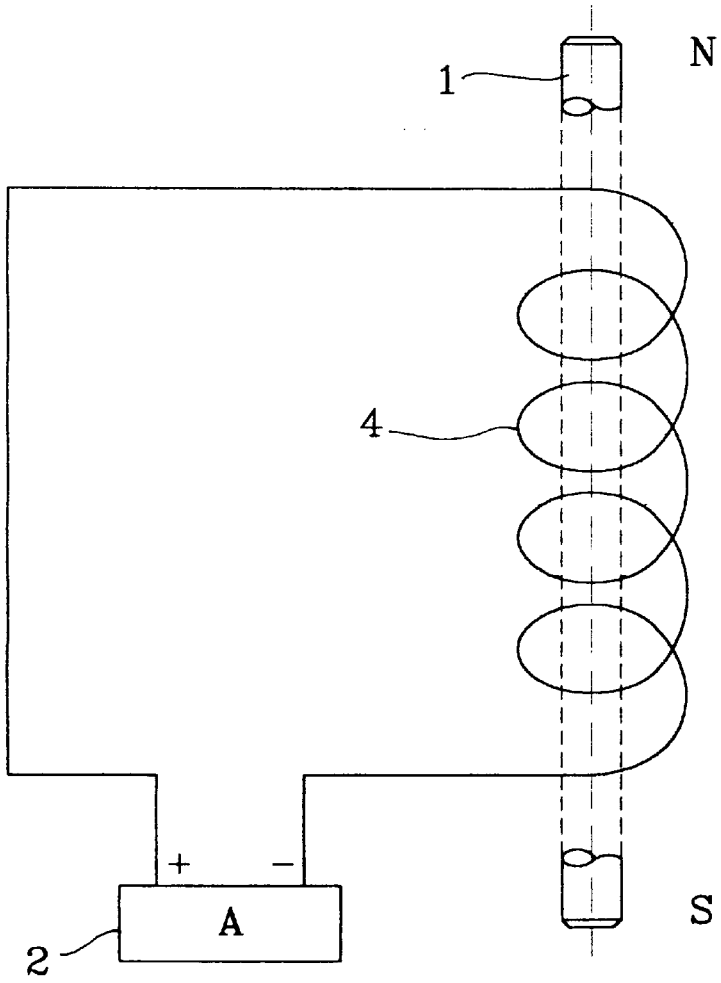
FIG. 2 shows circuit diagram of the pick-up device of FIG. 1.

As already said, referring to FIGS. 1 and 2, a string C of the instrument is part of the magnetic circuit including the permanent magnetic element 1 so that the vibrations of the string change the reluctance of the magnetic circuit and generate an induced electromotive force in coil 4-5 that is sent to amplifier 2.

The continuity in the transmission of signal between lead 4 and lead 5 of the double-lead winding is obtained through the capacitor ideally as the result of the amount of parasite capacities that are generated between each turn of lead 4 and the one of the lead 5. One can understand that the number of leads side by side can be more than two if properly connected to the amplifier.

According to the invention, a pick-up device endowed with a coil with a great number of turns, that is double respect to that one of a traditional pick-up device is obtained and then an elevate output level, without the consequential impossibility of reproducing high frequencies, is achieved.

Even if in the drawing the diagram shows only one coil, the. invention is applicable also to a double coil pick-up device. i. e. provided with another "humbucking" coil.

Figure 4:
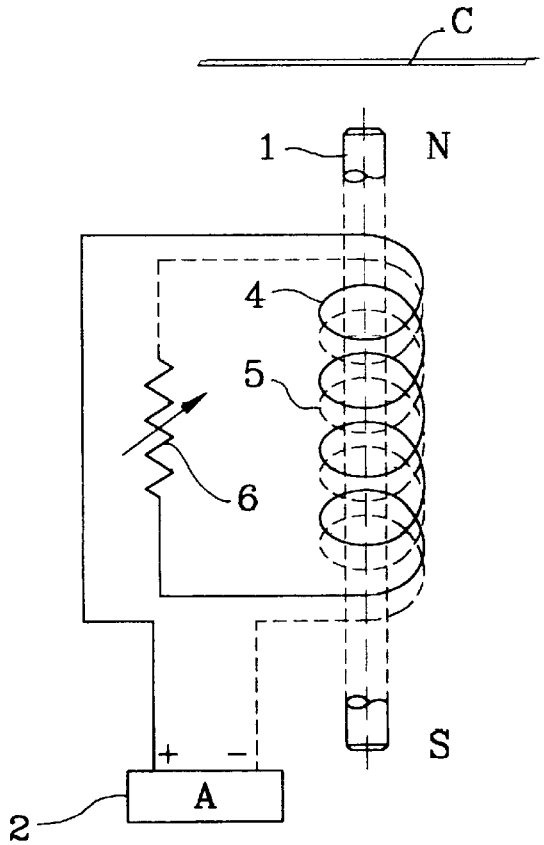
FIG. 4 shows a modified circuit diagram of the magnetic according to the invention.

Referring to FIG. 4, in which same signs are used for similar parts, an adequate either fixed or variable resistor 6 is connected to the free ends of the double-lead winding opposite to the ends connected to amplifier 2. In such a way a correction of the tone of the pick-up device is achieved. As before said, advantageously a pick-up device having a coil with a double number of turns respect to a traditional pick-up device is obtained, being further provided with an high impedance and able to reproduce optimally a greater number of low frequencies, with a reduced loss of high notes, with respect to the traditional pick-up device.

What is claimed is:

1. A magnetic pick-up device for stringed musical instrument, comprising at least one permanent magnetic element, round which a coil is wound, and a string of the musical instrument, being part of a magnetic circuit including said permanent magnetic element so that the vibrations of the string change the reluctance of the magnetic circuit and generate an induced electromotive force in the coil that is sent to a power amplifier, said coil comprising a double-lead winding having at each extremity a first end and a second end, said first end being connected to the power amplifier and said second end being free.

2. The magnetic pick-up device according to claim 1, wherein the double-lead winding consists of two side by side, insulated leads, wound in the same direction with coaxial turns.

3. The magnetic pick-up device according to claim 1, wherein the double-lead winding consists of two insulated leads, twisted together and wound in the same direction with coaxial turns.

4. The magnetic pick-up device according to claim 1, wherein the free ends of the double-lead winding are connected to the ends of a resistor.

5. The magnetic pick-up device according to claim 4, wherein said resistor is a fixed resistor.

6. The magnetic pick-up device according to claim 4, wherein said resistor is a variable resistor.

* * * * *